United States Patent [19]

Reiling et al.

[11] 4,069,625

[45] Jan. 24, 1978

[54] GRINDING HEAD FOR CARRYING A REPLACEABLE ABRASIVE SHEET

[76] Inventors: Karl Reiling; Reinhold Reiling, both of 9 Grundeltorstrasse, D-7531 Kampfelbach-Ersinger, Germany

[21] Appl. No.: 668,830

[22] Filed: Mar. 22, 1976

[30] Foreign Application Priority Data

Apr. 10, 1975 Germany ..... 2515737

[51] Int. Cl.[2] ..... B24D 9/08

[52] U.S. Cl. ..... 51/379

[58] Field of Search ..... 51/358, 376, 379, 377, 51/378, 380, 389, 390

[56] References Cited

U.S. PATENT DOCUMENTS

| | | | |
|---|---|---|---|
| 238,201 | 3/1881 | Andrew | 51/379 |
| 1,227,622 | 5/1917 | Hope | 51/378 |
| 1,966,521 | 7/1934 | Ricks | 51/378 X |
| 2,014,069 | 9/1935 | Jones | 51/378 |
| 2,453,222 | 11/1948 | Hammontree | 51/377 |
| 3,229,428 | 1/1966 | Sargolini | 51/390 X |

FOREIGN PATENT DOCUMENTS

| | | | |
|---|---|---|---|
| 249,656 | 4/1926 | United Kingdom | 51/379 |

*Primary Examiner*—Harold D. Whitehead
*Assistant Examiner*—Nicholas P. Godici

[57] ABSTRACT

In a grinding head for carrying replaceably an abrasive sheet and for detachable and driving connection to a portable rotary power unit, the abrasive sheet is applied to the outer face of a circular dished support member having an outer convex face and an inner concave face, from which latter a screw-threaded shank projects, and overlapping marginal edge portions of the sheet are clamped between the support member and a correspondingly shaped clamping member on the shank, the clamping member being of smaller diameter than the support member, and having its concave face facing the concave face of the support member.

4 Claims, 1 Drawing Figure

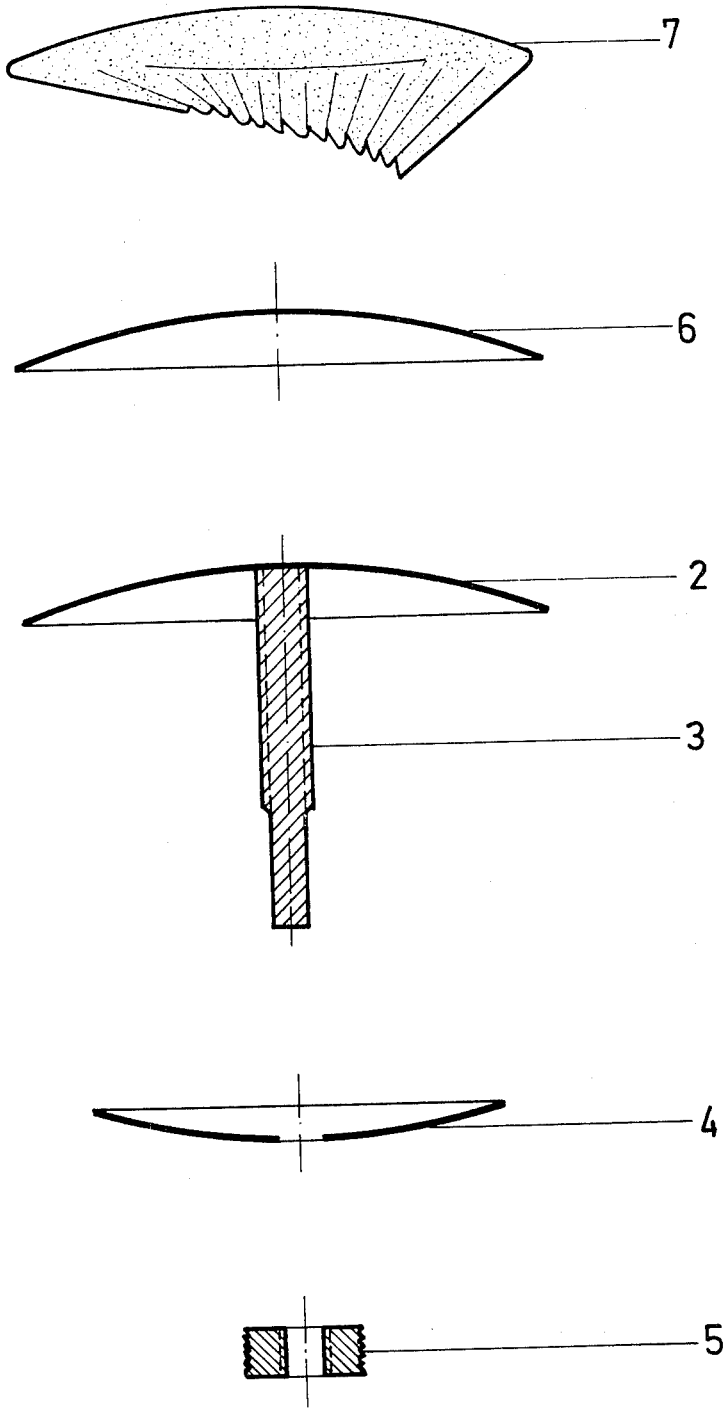
7
6
2
3
4
5

GRINDING HEAD FOR CARRYING A REPLACEABLE ABRASIVE SHEET

This invention relates to an abrading, buffing, or grinding head, hereinafter referred to as a grinding head, of the kind adapted to carry replaceably a sheet of abrasive material and to be detachably and drivingly connected to a portable rotary power unit.

Portable rotary power units to which various heads or tools for different purposes can be selectively attached are well known and are extensively used by home-workers or so-called "do-it-yourself" people.

An object of the present invention is to provide a grinding head as an attachment for a portable rotary power unit, which has no parts which can be easily lost, in which the replacement of abrasive sheets is simple, their attachment is secure, the abrasive sheet does not require to be specially shaped, and which is inexpensive to manufacture.

According to the present invention there is provided a grinding head of the kind adapted to carry replaceably an abrasive sheet and to be detachably and drivingly connected to a portable rotary power unit, said heat comprising a circular dished support member having a convex outer face and a concave inner face; a correspondingly shaped hard-padding member secured to the outer face of said support member; a shank having an inner end secured to and projecting centrally from the inner face of said support member, and having a screw-threaded inner end portion, and an outer end portion adapted to be detachably and drivingly connected to a portable rotary power unit; on said shank, a circular dished clamping member of smaller diameter than that of the support member and having an inner concave face facing the inner face of said support member, an outer convex face and a central hole through which said shank passes; and a clamping nut on said screw-threaded portion of the shank; whereby marginal edge portions of an abrasive sheet applied to the outer face of said padding member and overlapping same can be folded between said support member and said clamping member and be clamped between same by tightening said nut.

An embodiment of the invention will now be described, by way of example, with reference to the accompanying diagrammatic drawing, which shows an exploded sectional view of a grinding head according to the present invention.

Referring to the drawing, a grinding head consists of a support member 2, a spindle or shank 3, a clamping member 4, a clamping nut 5, and a hard-padding member 6. 7 indicates a sheet of abrasive material with its marginal edge portions folded partially inwards upon itself.

The members 2, 4 and 6 are all circular and dished and have outer convex faces and inner concave faces, the members 2 and 6 being of the same dimensions, and the clamping member 4 having a diameter smaller than that of the support member 2.

The shank 3 has a inner end secured to and projecting centrally from the inner face of the support member, and the shank 3 has a screw-threaded inner end portion, and an outer end portion for fitment to the chuck of a portable rotary power unit. The clamping disc 4 has a central hole.

The padding member 6 may be made of leather or plastics material and its inner face is secured by adhesive to the outer face of the support member 2 which may be made of metal, for example iron.

In use, the shank 3 is passed through the hole in the clamping member 4, with the inner face of the latter facing the inner face of the support member, and the nut 5 is screwed on to the shank 3. The sheet of abrasive material 7 is applied smoothly to the outer face of the padding member 6, and its overlapping marginal edge portions are folded in between the support member 2 and the clamping member 4. The nut 5 is then turned by hand so as to clamp the marginal portions of the sheet 7 firmly between the outer peripheral edge of the clamping member 4 and the support member 2.

The outer peripheral face of the nut 5 is preferably knurled, and the nut may be secured to the clamping member 4.

The clamping member 4, is of course, made of a material, such for example as metal, which is sufficiently rigid to enable clamping.

The outer end portion of the shank 3 is preferably of smaller cross sectional area than that of the screw-threaded portion of the shank, as shown, so as to facilitate fitment of the clamping disc 4 and the nut 5 to the shank.

When the clamping member 4 and the clamping nut 5 are in their in-use or clamping position, the clamping member 4, at least, and preferably also the nut 5, lie at least partially and preferably mainly or wholly within the depth of the support member 2. In this way, the overall depth or thickness of the members 2 and 4 is so small that the head can be used for grinding work tools such as scissors or shears, and pliers or pincers, or for grinding narrow grooves.

We claim:

1. A grinding head for carrying replaceably an abrasive sheet and for detachable and driving connection to a portable rotary power unit, said head consisting of a flattened plate-shaped support member having a convex outer face and a concave inner face; a sheet of thin hardened padding secured to the outer face of said support member, and taking the form thereof, said padding sheet having substantially the same dimensions as said outer face of said support member; a shank having an inner end secured to and projecting centrally from the inner face of said support member; and having a screw-threaded inner end portion, and an outer end portion adapted to be detachably and drivingly connected to a portable rotary power unit; on said shank, a flattened plate-shaped clamping member of smaller diameter than that of said support member and having an inner concave face facing the inner face of said support member, an outer convex face, and a central hole through which said shank passes, the peripheral edge of said clamping member being clamped to the inner concave face of said support member; and a clamping nut on said screw-threaded portion of said shank; whereby marginal edge portions of an abrasive sheet applied to the outer face of said sheet of thin hardened padding, and overlapping the latter, can be folded between said support member and said clamping member and be clamped between same by tightening said nut.

2. A grinding head as claimed in claim 1, in which the outer end portion of the shank is of smaller cross sectional area than that of the threaded portion of the shank.

3. A grinding head as claimed in claim 1, in which a sheet of abrasive material is applied to the outer face of the sheet of thin hardened padding and has marginal edge portions overlapping the padding member and folded and clamped between the support member and the clamping member.

4. A grinding head as claimed in claim 3, in which at least a major portion of the clamping member lies within the depth of the support member.

* * * * *